US009891547B2

(12) United States Patent
Tanabe et al.

(10) Patent No.: US 9,891,547 B2
(45) **Date of Patent: *Feb. 13, 2018**

(54) ULTRAVIOLET-CURABLE LIQUID DEVELOPER

(71) Applicant: CANON KABUSHIKI KAISHA, Tokyo (JP)

(72) Inventors: Hiroshi Tanabe, Yokohama (JP); Junji Ito, Hiratsuka (JP); Yasuhiro Aichi, Tokyo (JP); Naotake Sato, Sagamihara (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/166,643

(22) Filed: May 27, 2016

(65) Prior Publication Data

US 2016/0349653 A1 Dec. 1, 2016

(30) Foreign Application Priority Data

May 27, 2015 (JP) ..... 2015-107351
Mar. 7, 2016 (JP) ..... 2016-043295

(51) Int. Cl.
*G03G 9/13* (2006.01)
*G03G 9/12* (2006.01)
*G03G 9/125* (2006.01)

(52) U.S. Cl.
CPC ..... *G03G 9/131* (2013.01); *G03G 9/12* (2013.01); *G03G 9/125* (2013.01)

(58) Field of Classification Search
CPC ..... G03G 9/12; G03G 9/125
See application file for complete search history.

(56) References Cited

U.S. PATENT DOCUMENTS 5,364,726 A 11/1994 Morrison et al.
5,395,724 A 3/1995 Morrison et al.
7,981,488 B2 7/2011 Fukagawa et al.
2003/0231234 A1* 12/2003 Ushirogouchi ..... B41J 2/0057 347/100
2005/0122041 A1 6/2005 Tanabe et al.
2010/0136474 A1 6/2010 Iwase et al.
2010/0136475 A1 6/2010 Iwase et al.
2010/0201043 A1* 8/2010 Houle ..... C09D 4/00 264/496
2011/0096132 A1* 4/2011 Kobayashi ..... B41J 11/002 347/102
2012/0289697 A1* 11/2012 Murai ..... C07D 221/14 544/126
2013/0209933 A1 8/2013 Sato
2015/0192875 A1 7/2015 Ito et al.
2016/0349652 A1* 12/2016 Natori ..... G03G 9/08755
2016/0349655 A1* 12/2016 Natori ..... G03G 9/0819
2016/0349656 A1* 12/2016 Hasegawa ..... G03G 9/0806

FOREIGN PATENT DOCUMENTS

JP 2003-057883 A 2/2003
JP 2003-241439 A 8/2003
JP 3442406 B2 9/2003
JP 2013152348 A * 8/2013
WO 2006126566 A1 11/2006
WO 2007000974 A1 1/2007
WO 2007000975 A1 1/2007
WO 2007108485 A1 9/2007

OTHER PUBLICATIONS

English language machine translation of JP 2013-152348 (Aug. 2013).*
Kayacure Radiation Curable Products, Tokyo: Nippon Kayaku. 12 pages (Dec. 2016).*
Y. Harasaki, "Coating Basics and Engineering", Converting Technical Institute, p. 53, Table 3.9.
W. Herbst, et al., "Industrial Organic Pigments", List of Commercially Available Pigments, 637-45.

* cited by examiner

*Primary Examiner* — Christopher D RoDee
(74) *Attorney, Agent, or Firm* — Fitzpatrick Cella Harper and Scinto

(57) ABSTRACT

Provided is a ultraviolet-curable liquid developer containing a toner particle, a cationically polymerizable liquid monomer, and a photoinitiator that contains a compound according to formula (1):

(1)

The cationically polymerizable liquid monomer contains a vinyl ether compound satisfying A/B×1,000≥8.5, wherein A is the molar average number of functional groups for the vinyl ether compound and B is the molar average molecular weight of the vinyl ether compound.

6 Claims, No Drawings

ULTRAVIOLET-CURABLE LIQUID DEVELOPER

BACKGROUND OF THE INVENTION

Field of the Invention

The present invention relates to a liquid developer for use in image-forming apparatuses that utilize an electrophotographic system, for example, electrophotography, electrostatic recording, and electrostatic printing.

Description of the Related Art

An electrophotographic system is a method in which printed material is obtained by uniformly charging the surface of an image bearing member such as a photosensitive member (charging step), forming an electrostatic latent image by photoexposure on the surface of the image bearing member (photoexposure step), developing the thus formed electrostatic latent image with a developer that contains colored resin particles (development step), transferring the developer image to a recording medium such as paper or plastic film (transfer step), and fixing the transferred developer image to the recording medium (fixing step).

The developers here are broadly classified into dry developers and liquid developers: colored resin particles constituted of a material that contains a binder resin and a colorant such as a pigment are used in a dry state in the former, while the colored resin particles are dispersed in an electrically insulating liquid in the latter.

The need for color output and high-speed printing from image-forming apparatuses that use an electrophotographic system, e.g., copiers, facsimile machines, printers, and so forth, has been increasing in recent years. In the realm of color printing, the demand for high-resolution, high-quality images has resulted in demand for developers that can accommodate high-speed printing while having the ability to form high-resolution, high-quality images.

Liquid developers are known to be developers that offer advantages with regard to color image reproducibility. With a liquid developer, the occurrence during storage of aggregation of the colored resin particles in the liquid developer is suppressed, and due to this, a microfine toner particle can be used. As a consequence, excellent properties with regard to the reproducibility of fine line images and the reproducibility of gradations are readily obtained with a liquid developer. Development is becoming quite active with regard to high-image-quality, high-speed digital printing apparatuses that exploit these excellent features by utilizing electrophotographic technologies that use liquid developers. In view of these circumstances, there is demand for the development of liquid developers that have even better properties.

A dispersion of colored resin particles in an electrically insulating liquid, e.g., a hydrocarbon organic solvent or silicone oil, is already known as a liquid developer. However, when the electrically insulating liquid remains present on the recording medium, e.g., paper or plastic film, this ends up causing a substantial decline in the appearance of the image, and due to this the electrically insulating liquid must be removed. In a method generally used to remove the electrically insulating liquid, thermal energy is applied to volatilize and remove the electrically insulating liquid. However, this has not necessarily been preferred from an environmental and/or an energy-savings perspective when the emission of an organic solvent vapor from the apparatus has been a possibility at this point and/or when large amounts of energy have been required.

As a countermeasure to this, a method has been introduced in which the electrically insulating liquid is cured by photopolymerization. A photocurable liquid developer used here uses a reactive functional group-bearing monomer or oligomer as the electrically insulating liquid and has a photoinitiator dissolved therein. This photocurable liquid developer can also accommodate high speeds because it is cured by the reaction of the reactive functional groups upon exposure to light, e.g., ultraviolet light. Such a photocurable liquid developer is proposed in Japanese Patent Application Laid-open No. 2003-57883. Acrylate monomer, e.g., urethane acrylate, is provided in Japanese Patent Application Laid-open No. 2003-57883 as an example of the reactive functional group-bearing monomer.

Japanese Patent No. 3,442,406 proposes the use, as a curable electrically insulating liquid, of a curable liquid vehicle that has a prescribed range for its viscosity and a prescribed range for its resistance value. Epoxy compounds, vinyl ethers, and cyclic vinyl ethers are given as examples of the curable liquid vehicle.

SUMMARY OF THE INVENTION

However, the aforementioned acrylate monomer has a low volume resistivity and facilitates a drop in the potential of the electrostatic latent image in the development step, and due to this the ability to obtain a high image density is impaired and image blurring is produced (the image sharpness is degraded).

Vinyl ether compounds, on the other hand, support the generation of a high volume resistivity and provide a fast reaction rate and are thus favorable curable electrically insulating liquids; however, they generally require the use of an ionic photoacid generator in combination with a photoinitiator for cationic polymerization.

When, however, a vinyl ether compound is mixed with an ionic photoacid generator, the volume resistivity ends up undergoing a large decline from that for the vinyl ether compound by itself.

Due to this, liquid developers that contain a vinyl ether compound and an ionic photoacid generator have suffered the problems of an impaired ability to provide a high image density and also the occurrence of image blurring.

The present invention provides a liquid developer that solves these problems.

That is, the present invention provides an ultraviolet-curable liquid developer that yields a high image density, that resists the occurrence of image blurring, and that has a satisfactory fixing performance.

The present invention is an ultraviolet-curable liquid developer that contains a cationically polymerizable liquid monomer, a photoinitiator, and a toner particle, wherein the cationically polymerizable liquid monomer contains a vinyl ether compound; defining A as the molar average number of functional groups for the vinyl ether compound and B as the molar average molecular weight of the vinyl ether compound, A and B satisfy the relationship $A/B \times 1{,}000 \geq 8.5$; and the photoinitiator contains a compound with the following formula (1):

formula (1)

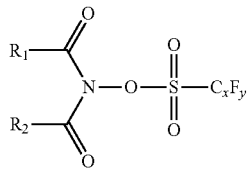

[In formula (1), $R_1$ and $R_2$ are bonded to each other to form a ring structure; x represents an integer that is at least 1 and not more than 8; and y represents an integer that is at least 3 and not more than 17.]

The present invention can provide an ultraviolet-curable liquid developer that yields a high image density, that resists the production of image blurring, and that has a satisfactory fixing performance.

Further features of the present invention will become apparent from the following description of exemplary embodiments.

DESCRIPTION OF THE EMBODIMENTS

The present invention is described in detail in the following.

The ultraviolet-curable liquid developer of the present invention contains a cationically polymerizable liquid monomer, a photoinitiator, and a toner particle.

Each of the constituent components present in the ultraviolet-curable liquid developer of the present invention is described in the following.

[The Photoinitiator]

The photoinitiator used by the present invention contains a compound with the following formula (1).

formula (1)

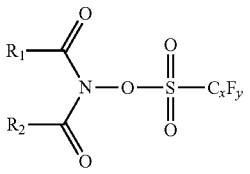

[In formula (1), $R_1$ and $R_2$ are bonded to each other to form a ring structure; x represents an integer that is at least 1 and not more than 8; and y represents an integer that is at least 3 and not more than 17.]

Under exposure to ultraviolet radiation, the photoinitiator with formula (1) undergoes photolysis and generates a sulfonic acid, a strong acid. When a photopolymerization sensitizer is co-used therewith, the absorption of ultraviolet radiation by the photopolymerization sensitizer can also act as a trigger to bring about degradation of the photoinitiator and production of the sulfonic acid.

The use of the photoinitiator with formula (1), while making possible an excellent fixing performance, also provides a high-resistance liquid developer, unlike the case for the use of an ionic photoacid generator.

The ring structure formed by the bonding of $R_1$ to $R_2$ can be exemplified by five-membered rings and six-membered rings. Specific examples of the ring structure formed by the bonding of $R_1$ to $R_2$ are, for example, the succinimide structure, phthalimide structure, norbornenedicarboximide structure, naphthalenedicarboximide structure, cyclohexanedicarboximide structure, and epoxycyclohexenedicarboximide structure.

These ring structures may also have an alkyl group, alkyloxy group, alkylthio group, aryl group, aryloxy group, or arylthio group as a substituent. Another ring structure, e.g., a possibly substituted alicycle, heterocycle, aromatic ring, and so forth, may also be condensed.

The $C_xF_y$ group, which has a strong electron-withdrawing character, is a fluorocarbon group and is a functional group for bringing about decomposition of the sulfonate ester moiety upon exposure to ultraviolet radiation. The number of carbon atoms here is at least 1 and not more than 8 (x is at least 1 and not more than 8), and the number of fluorine atoms is at least 3 and not more than 17 (y is at least 3 and not more than 17).

Synthesis of the strong acid proceeds readily when the number of carbon atoms is at least 1, while the storage stability is excellent when the number of carbon atoms is not more than 8. The number of carbon atoms is preferably at least 1 and not more than 4.

Function as a strong acid is possible when the number of fluorine atoms is at least 3, while synthesis of the strong acid proceeds readily when the number of fluorine atoms is not more than 17. The number of fluorine atoms is preferably at least 3 and not more than 9.

The $C_xF_y$ group in formula (1) can be exemplified by linear-chain alkyl groups in which the hydrogen atom has been substituted by the fluorine atom (RF1), branched-chain alkyl groups in which the hydrogen atom has been substituted by the fluorine atom (RF2), cycloalkyl groups in which the hydrogen atom has been substituted by the fluorine atom (RF3), and aryl groups in which the hydrogen atom has been substituted by the fluorine atom (RF4).

The linear-chain alkyl groups in which the hydrogen atom has been substituted by the fluorine atom (RF1) can be exemplified by the trifluoromethyl group (x=1, y=3), pentafluoroethyl group (x=2, y=5), heptafluoro-n-propyl group (x=3, y=7), nonafluoro-n-butyl group (x=4, y=9), perfluoro-n-hexyl group (x=6, y=13), and perfluoro-n-octyl group (x=8, y=17).

The branched-chain alkyl groups in which the hydrogen atom has been substituted by the fluorine atom (RF2) can be exemplified by the perfluoroisopropyl group (x=3, y=7), perfluoro-tert-butyl group (x=4, y=9), and perfluoro-2-ethylhexyl group (x=8, y=17).

The cycloalkyl groups in which the hydrogen atom has been substituted by the fluorine atom (RF3) can be exemplified by the perfluorocyclobutyl group (x=4, y=7), perfluorocyclopentyl group (x=5, y=9), perfluorocyclohexyl group (x=6, y=11), and perfluoro(1-cyclohexyl)methyl group (x=7, y=13).

The aryl groups in which the hydrogen atom has been substituted by the fluorine atom (RF4) can be exemplified by the pentafluorophenyl group (x=6, y=5) and 3-trifluoromethyltetrafluorophenyl group (x=7, y=7).

Among $C_xF_y$ groups with formula (1), the linear-chain alkyl groups (RF1), branched-chain alkyl groups (RF2), and aryl groups (RF4) are preferred from the standpoint of the ease of acquisition and the decomposability of the sulfonate ester moiety. The linear-chain alkyl groups (RF1) and aryl groups (RF4) are more preferred. The trifluoromethyl group (x=1, y=3), pentafluoroethyl group (x=2, y=5), heptafluoro-n-propyl group (x=3, y=7), nonafluoro-n-butyl group (x=4, y=9), and pentafluorophenyl group (x=6, y=5) are particularly preferred.

A single photoinitiator can be used or two or more can be used in combination. In addition, a photoinitiator other than the compound with formula (1) may also be incorporated to the degree that the effects of the present invention are not impaired.

The content of the photoinitiator (for example, the compound with formula (1)) in the ultraviolet-curable liquid developer in the present invention is not particularly limited, but, expressed with reference to 100 mass parts of the cationically polymerizable liquid monomer, is preferably at least 0.01 mass parts and not more than 5.00 mass parts, more preferably at least 0.05 mass parts and not more than 1.00 mass part, and even more preferably at least 0.10 mass parts and not more than 0.50 mass parts.

When the content of the compound with formula (1) is less than 0.01 mass parts, a trend is assumed of a deficient amount of sulfonic acid production under exposure to ultraviolet radiation and the fixing performance may then decline.

When, on the other hand, the content of the compound with formula (1) exceeds 5.00 mass parts, a trend is assumed of a declining volume resistivity for the ultraviolet-curable liquid developer and a trend of a declining developing performance is then assumed, and/or a trend of a declining storability is assumed due to the production of a large amount of the sulfonic acid due to thermal degradation during storage.

In addition, the compound with formula (1) is a compound with the following formula (2) in a preferred embodiment.

formula (2)

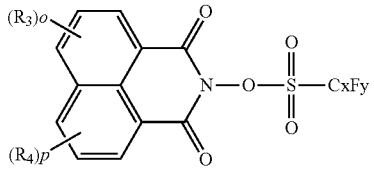

[In formula (2), x represents an integer that is at least 1 and not more than 8; y represents an integer that is at least 3 and not more than 17; $R_3$ and $R_4$ each independently represent an alkyl group, alkyloxy group, alkylthio group, aryl group, aryloxy group, or arylthio group; o and p each independently represent an integer that is at least 0 and not more than 3; when o is equal to or greater than 2, a plurality of $R_3$ may be bonded to each other to form a ring structure; when p is equal to or greater than 2, a plurality of $R_4$ may be bonded to each other to form a ring structure; and an $R_3$ and $R_4$ may be bonded to each other to form a ring structure.]

Preferably $R_3$ and $R_4$ each independently represent a $C_{1-18}$ alkyl group, $C_{1-18}$ alkyloxy group, $C_{1-18}$ alkylthio group, $C_{1-14}$ aryl group, $C_{1-14}$ aryloxy group, or $C_{1-14}$ arylthio group.

Specific examples of the photoinitiator with formula (1) are given below [example compounds A-1 to A-27], but the present invention is not limited to or by these examples.

Among these specific examples, (A-23), (A-24), (A-25), (A-26), and (A-27) facilitate the appearance of a high fixing performance through their combination with a photopolymerization sensitizer.

(A-1)

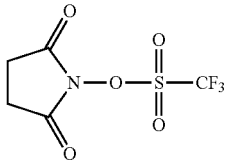

(A-2)

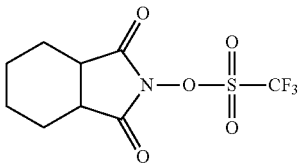

-continued (A-3)

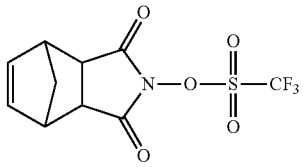

(A-4)

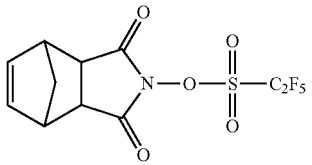

(A-5)

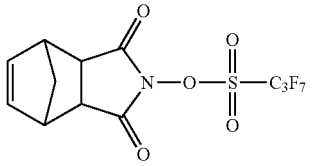

(A-6)

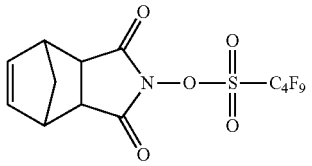

(A-7)

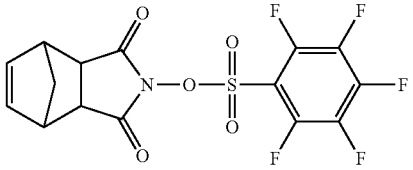

(A-8)

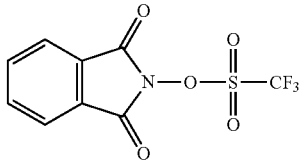

(A-9)

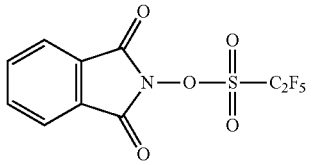

(A-10)

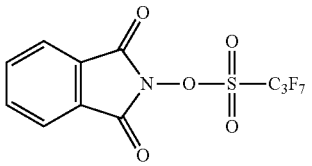

(A-11)

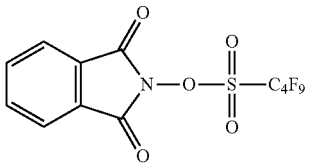

-continued
(A-12)
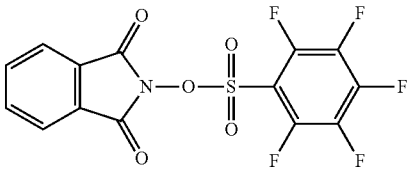
(A-13)
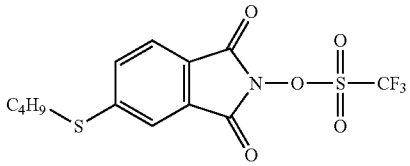
(A-14)
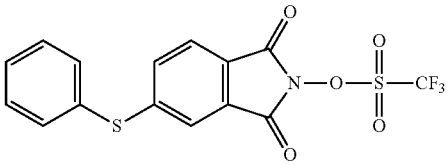
(A-15)
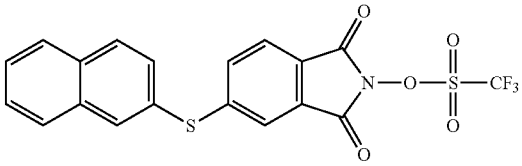
(A-16)
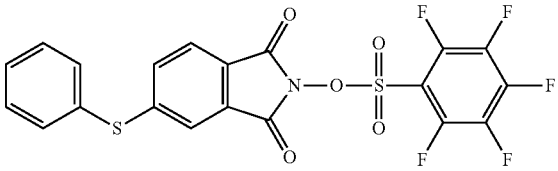
(A-17)
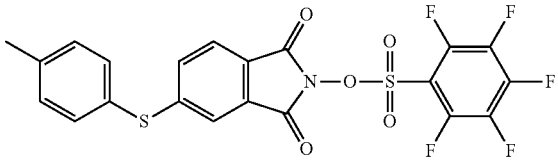
(A-18)
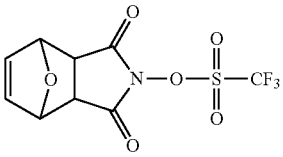
(A-19)
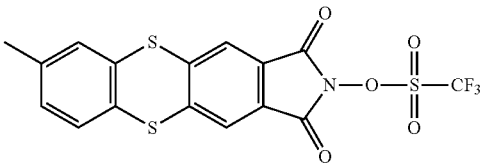
-continued
(A-20)
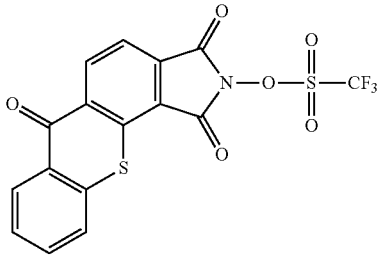
(A-21)
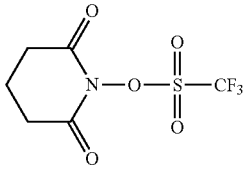
(A-22)
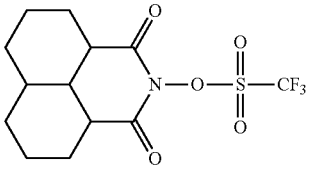
(A-23)
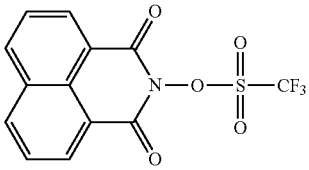
(A-24)
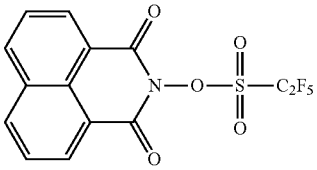
(A-25)
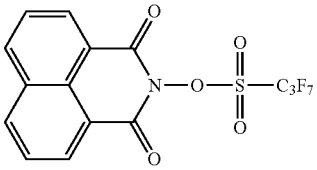
(A-26)
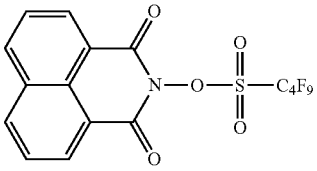

-continued (A-27)

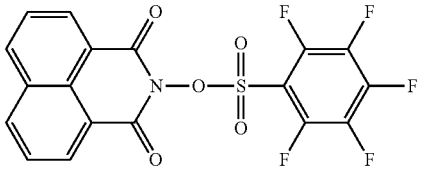

[The Cationically Polymerizable Liquid Monomer]

The cationically polymerizable liquid monomer is selected in the present invention from liquids that have a high volume resistivity, that are electrically insulating, and that have a low viscosity at around room temperature.

In addition, the cationically polymerizable liquid monomer is preferably selected from liquids that do not dissolve the binder resin that is present in the toner particle.

Specifically, selection is preferably made from cationically polymerizable liquid monomer/binder resin combinations for which not more than 1 mass parts of the binder resin dissolves at a temperature of 25° C. in 100 mass parts of the cationically polymerizable liquid monomer.

The volume resistivity of the cationically polymerizable liquid monomer here is preferably approximately at least $1\times10^{9}$ Ω·cm and not more than $1\times10^{15}$ Ω·cm and is more preferably approximately at least $1\times10^{1c}$ Ω·cm and not more than $1\times10^{15}$ Ω·cm.

A volume resistivity of less than $1\times10^{9}$ Ω·cm facilitates a drop in the potential of the electrostatic latent image and sets up a trend of impeding the generation of a high optical density and/or a trend of facilitating the occurrence of image blurring.

The viscosity of the cationically polymerizable liquid monomer at 25° C., on the other hand, is preferably approximately at least 0.5 mPa·s and less than 100 mPa·s and is more preferably at least 0.5 mPa·s and less than 20 mPa·s.

This cationically polymerizable liquid monomer in the ultraviolet-curable liquid developer of the present invention contains a vinyl ether compound. In addition, a cationically polymerizable liquid monomer other than a vinyl ether compound may also be present to the extent that the effects of the present invention are not impaired.

The use of a vinyl ether compound in the present invention makes it possible to obtain an ultraviolet-curable liquid developer that exhibits a high volume resistivity, a low viscosity, and a high sensitivity.

The present inventors hypothesize that this expression of favorable characteristics is caused by the small intramolecular polarization of the electron density in vinyl ether compounds.

Here, the vinyl ether compound refers to a compound that has a vinyl ether structure (—CH═CH—O—C—).

This vinyl ether structure is preferably given by R—CH═CH—O—C— (R is hydrogen or $C_{1-3}$ alkyl and is preferably hydrogen or methyl).

Acrylic monomers and cyclic ether monomers, e.g., epoxides and oxetanes, are also widely used as the aforementioned cationically polymerizable liquid monomer. However, acrylic monomers exhibit intramolecular polarization of the electron density and, due to the operation of intermolecular electrostatic interactions, it is difficult to obtain a low-viscosity liquid developer and a declining trend is also assumed for the volume resistivity.

With cyclic ether monomers, on the other hand, it also difficult to obtain a high volume resistivity and in addition the polymerization reaction rate tends to be significantly lower than for vinyl ether compounds.

In one preferred embodiment in the present invention, the vinyl ether compound is also a compound that does not contain a heteroatom outside the vinyl ether structure.

Here, "heteroatom" denotes an atom other than the carbon atom and hydrogen atom.

When it is a compound that does not contain a heteroatom outside the vinyl ether structure, intramolecular polarization of the electron density is suppressed and a high volume resistivity is readily obtained.

In another preferred embodiment in the present invention, the vinyl ether compound also does not contain a carbon-carbon double bond outside of the vinyl ether structure in the vinyl ether compound. Polarization of the electron density is suppressed and a high volume resistivity is readily obtained with a vinyl ether compound that does not contain a carbon-carbon double bond outside of the vinyl ether structure.

The vinyl ether compound is preferably given by the following formula (C) in the present invention.

formula (C)

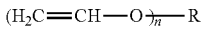

[In formula (C), n represents the number of vinyl ether structures in one molecule and is an integer that is at least 1 and not more than 4. R is an n-valent hydrocarbon group.]

n is preferably an integer that is at least 1 and not more than 3.

R preferably is a group selected from $C_{1-2C}$ linear-chain or branched, saturated or unsaturated aliphatic hydrocarbon groups, $C_{5-12}$ saturated or unsaturated alicyclic hydrocarbon groups, and $C_{6-14}$ aromatic hydrocarbon groups, and these alicyclic hydrocarbon groups and aromatic hydrocarbon groups may have a $C_{1-4}$ saturated or unsaturated aliphatic hydrocarbon group.

R is more preferably a $C_{4-18}$ linear-chain or branched saturated aliphatic hydrocarbon group.

Specific examples of vinyl ether compounds are given below [example compounds B-1 to B-30], but the present invention is not limited to or by these examples.

(B-1)

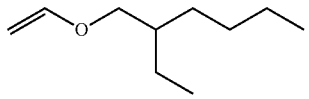

(B-2)

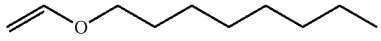

(B-3)

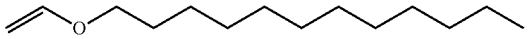

(B-4)

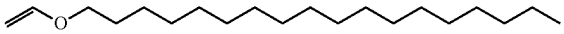

(B-5)

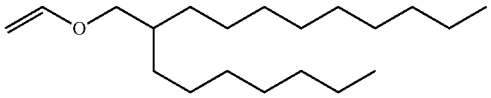

(B-6)

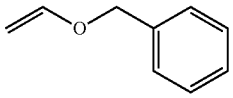

-continued (B-7)

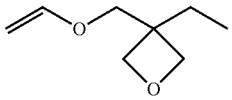

(B-8)

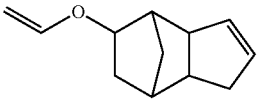

(B-9)

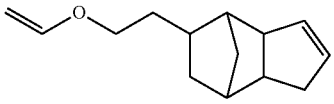

(B-10)

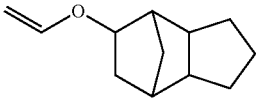

(B-11)

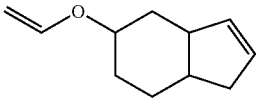

(B-12)

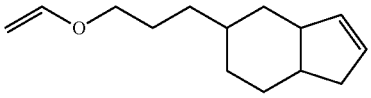

(B-13)

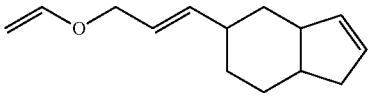

(B-14)

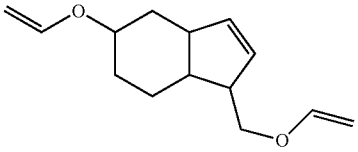

(B-15)

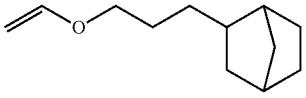

(B-16)

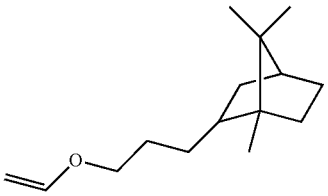

(B-17)

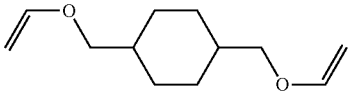

(B-18)

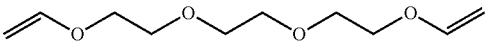

(B-19)

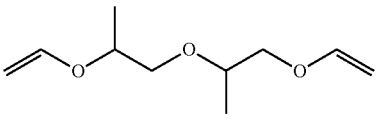

-continued (B-20)

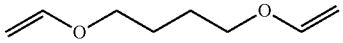

(B-21)

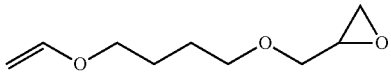

(B-22)

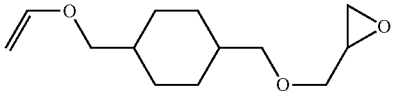

(B-23)

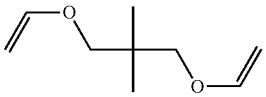

(B-24)

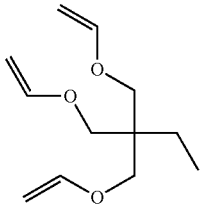

(B-25)

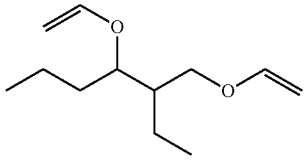

(B-26)

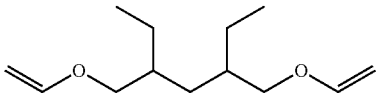

(B-27)

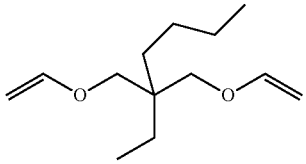

(B-28)

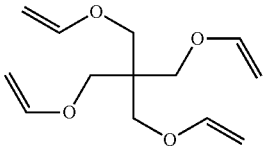

(B-29)

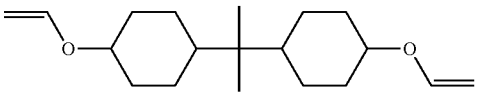

(B-30)

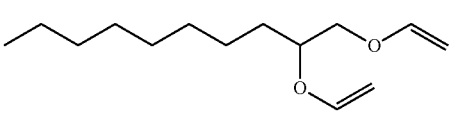

The present invention focuses on the density of the vinyl ether structure in the vinyl ether compound.

The cure of a cationically polymerizable ultraviolet-curable resin is readily inhibited by moisture, and as a consequence the cure of an ultraviolet-curable resin is made more difficult by an increase in the humidity of the curing environment.

A cationic polymerization reaction is generally considered to be a polymerization reaction in which the acid produced by degradation from the polymerization initiator upon exposure to light reacts with monomer to produce a cationic active species, with the polymerization reaction proceeding successively as long as this cationic active species is present.

With the present invention, it is thought that the acid generated from the polymerization initiator reacts with the vinyl ether structure to produce a cationic active species. When a water molecule is present in the vicinity of the monomer at this time, this cationic active species is trapped and polymerization does not occur beyond this.

That is, the chain extension reaction of one vinyl ether structure is stopped per one water molecule.

Based on this, the present inventors discovered that by raising the density of the vinyl ether structures in the vinyl ether compound, the polymerization reaction will advance—even in the event of the consumption of vinyl ether structures by water molecules—due to the presence of other vinyl ether structures in large numbers.

In addition, the density of the vinyl ether structure was represented with a relational expression between the molar average number of functional groups for the vinyl ether compound and the molar average molecular weight of the vinyl ether compound.

Thus, defining A as the molar average number of functional groups for the vinyl ether compound and B as the molar average molecular weight of the vinyl ether compound, A and B satisfy the relationship $A/B\times1{,}000\geq8.5$ in the present invention.

A value for $A/B\times1{,}000$ that is equal to or greater than 8.5 suppresses the influence exercised by humidity.

A value for $A/B\times1{,}000$ that is equal to or greater than 9.5 is preferred because this provides a greater suppression of the influence of humidity.

The value of $A/B\times1{,}000$ is preferably not more than 18.

Based on the preceding, among the monomers provided above as examples, monomers that have a relatively small molar average molecular weight, or that have a relatively large molar average number of functional groups, are preferred.

In order to satisfy the aforementioned value for [$A/B\times1{,}000$], a single vinyl ether compound may be used by itself or two or more may be used in combination.

The following are preferred example compounds among the specific examples given above: dodecyl vinyl ether (B-3), dicyclopentadiene vinyl ether (B-8), tricyclodecane vinyl ether (B-10), cyclohexanedimethanol divinyl ether (B-17), neopentyl glycol divinyl ether (B-23), trimethylolpropane trivinyl ether (B-24), 2-ethyl-1,3-hexanediol divinyl ether (B-25), 2,4-diethyl-1,5-pentanediol divinyl ether (B-26), 2-butyl-2-ethyl-1,3-propanediol divinyl ether (B-27), pentaerythritol tetravinyl ether (B-28), and 1,2-decanediol divinyl ether (B-30).

[The Toner Particle]

The ultraviolet-curable liquid developer of the present invention contains a toner particle.

The toner particle preferably contains a binder resin and a colorant.

<Binder Resin>

A known binder resin can be used—as long as it is insoluble in the aforementioned cationically polymerizable liquid monomer and exhibits a fixing performance for the adherend, e.g., paper or plastic film—as the binder resin present in the toner particle.

Here, this "insoluble in the cationically polymerizable liquid monomer" is provided as an indicator that not more than 1 mass parts of the binder resin dissolves at a temperature of 25° C. in 100 mass parts of the cationically polymerizable liquid monomer.

Specific examples of this binder resin are resins such as epoxy resins, ester resins, (meth)acrylic resins, styrene-(meth)acrylic resins, alkyd resins, polyethylene resins, ethylene-(meth)acrylic resins, and rosin-modified resins. As necessary, a single one of these can be used or two or more can be used in combination.

The content of the binder resin is not particularly limited, but is preferably 50 to 1,000 mass parts per 100 mass parts of the colorant.

<Colorant>

There are no particular limitations on the colorant incorporated in the toner particle, and, for example, any generally commercially available organic pigment, organic dye, inorganic pigment, or pigment dispersed in, e.g., an insoluble resin as a dispersion medium, or pigment having a resin grafted to its surface can be used.

These pigments can be exemplified by the pigments described in, for example, "Industrial Organic Pigments", W. Herbst and K. Hunger.

The following are specific examples of pigments that present a yellow color:

C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Pigments that present a red or magenta color can be exemplified by the following:

C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

Pigments that present a blue or cyan color can be exemplified by the following:

C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Pigments that present a green color can be exemplified by the following:

C. I. Pigment Green 7, 8, and 36.

Pigments that present an orange color can be exemplified by the following:

C. I. Pigment Orange 66 and 51.

Pigments that present a black color can be exemplified by the following:

carbon black, titanium black, and aniline black.

The following are specific examples of white pigments:

basic lead carbonate, zinc oxide, titanium oxide, and strontium titanate.

A dispersing means adapted to the toner particle production method may be used to disperse the pigment in the toner particle. Devices that can be used as this dispersing means are, for example, a ball mill, sand mill, attritor, roll mill, jet mill, homogenizer, paint shaker, kneader, agitator, Henschel mixer, colloid mill, ultrasonic homogenizer, pearl mill, wet jet mill, and so forth.

A pigment dispersing agent may also be added when pigment dispersion is carried out. The pigment dispersing agent can be exemplified by hydroxyl group-bearing carboxylate esters, the salts of long-chain polyaminoamides and high molecular weight acid esters, the salts of high molecular weight polycarboxylic acids, high molecular weight unsaturated acid esters, high molecular weight copolymers, modified polyacrylates, aliphatic polybasic carboxylic acids, naphthalenesulfonic acid/formalin condensates, polyoxyethylene alkyl phosphate esters, and pigment derivatives. The use of commercially available high molecular weight pigment dispersing agents such as the Solsperse series from The Lubrizol Corporation is also preferred.

A synergist adapted to the particular pigment may also be used as a pigment dispersing aid.

These pigment dispersing agents and pigment dispersing aids are added preferably at 1 to 50 mass parts per 100 mass parts of the pigment.

The ultraviolet-curable liquid developer of the present invention may as necessary contain a charge control agent.

Known charge control agents can be used without particular limitation as this charge control agent as long as the known charge control agent causes little reduction in the volume resistivity of the ultraviolet-curable liquid developer and little increase in the viscosity thereof. Examples of specific compounds are as follows:

fats and oils such as linseed oil and soy oil; alkyd resins; halogen polymers; aromatic polycarboxylic acids; acidic group-containing water-soluble dyes; oxidative condensates of aromatic polyamines; metal soaps such as zirconium naphthenate, cobalt naphthenate, nickel naphthenate, iron naphthenate, zinc naphthenate, cobalt octoate, nickel octoate, zinc octoate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin and hydrogenated lecithin; metal salts of salicylic acid, e.g., metal complexes of tert-butylsalicylic acid; polyvinylpyrrolidone resins; polyamide resins; sulfonic acid-containing resins; and hydroxybenzoic acid derivatives.

The content of the charge control agent in the present invention, expressed per 100 mass parts of the toner particle (solids fraction), is preferably at least 0.01 mass parts and not more than 10 mass parts and more preferably at least 0.05 mass parts and not more than 5 mass parts.

<Charge Adjuvant>

A charge adjuvant can as necessary be incorporated in the toner particle. A known charge adjuvant can be used as this charge adjuvant.

Examples of specific compounds are as follows: metal soaps such as zirconium naphthenate, cobalt naphthenate, nickel naphthenate, iron naphthenate, zinc naphthenate, cobalt octoate, nickel octoate, zinc octoate, cobalt dodecanoate, nickel dodecanoate, zinc dodecanoate, aluminum stearate, aluminum tristearate, and cobalt 2-ethylhexanoate; metal sulfonates such as petroleum-based metal sulfonates and the metal salts of sulfosuccinate esters; phospholipids such as lecithin and hydrogenated lecithin; metal salts of salicylic acid, e.g., metal complexes of tert-butylsalicylic acid; polyvinylpyrrolidone resins; polyamide resins; sulfonic acid-containing resins; and hydroxybenzoic acid derivatives.

As necessary, a photopolymerization sensitizer may also be incorporated in the ultraviolet-curable liquid developer of the present invention with the goals of, for example, improving the acid-generating efficiency of the aforementioned photoinitiator and extending the photosensitive wavelengths to longer wavelengths.

There are no particular limitations on this photopolymerization sensitizer as long as it is capable of sensitizing the photoinitiator through an electron transfer mechanism or energy transfer mechanism.

Specific examples are as follows: aromatic polycondensed ring compounds such as anthracene, 9,10-dialkoxyanthracene, pyrene, and perylene; aromatic ketone compounds such as acetophenone, benzophenone, thioxanthone, and Michler's ketone; and heterocyclic compounds such as phenothiazine and N-aryloxazolidinone.

Preferred examples among the preceding are anthracene compounds such as 9,10-diethoxyanthracene, 9,10-dipropoxyanthracene, and 9,10-dibutoxyanthracene, as well as thioxanthone compounds such as 2,4-diethylthioxanthone and 2-isopropylthioxanthone.

A single one of these photopolymerization sensitizers can be used or two or more can be used in combination.

The content of the photopolymerization sensitizer is selected as appropriate in correspondence to the goal, but, expressed per 1 mass parts of the photoinitiator, is preferably at least 0.1 mass parts and not more than 10.0 mass parts and is more preferably at least 1.0 mass parts and not more than 5.0 mass parts.

A photopolymerization sensitizing aid may also be incorporated in the ultraviolet-curable liquid developer of the present invention with the goal of improving the electron transfer efficiency or energy transfer efficiency between the aforementioned photopolymerization sensitizer and photoinitiator.

The photopolymerization sensitizing aid can be specifically exemplified by the following: naphthalene compounds such as 1,4-dihydroxynaphthalene, 1,4-dimethoxynaphthalene, 1,4-diethoxynaphthalene, 4-methoxy-1-naphthol, and 4-ethoxy-1-naphthol, and benzene compounds such as 1,4-dihydroxybenzene, 1,4-dimethoxybenzene, 1,4-diethoxybenzene, 1-methoxy-4-phenol, and 1-ethoxy-4-phenol.

The naphthalene compounds are preferred examples among the preceding.

A single one of these photopolymerization sensitizing aid can be used or two or more can be used in combination.

The content of the photopolymerization sensitizing aid is selected as appropriate in correspondence to the goal, but, expressed per 1 mass parts of the photopolymerization sensitizer, is preferably at least 0.1 mass parts and not more than 10.0 mass parts and is more preferably at least 0.5 mass parts and not more than 5.0 mass parts.

<Cationic Polymerization Inhibitor>

The ultraviolet-curable liquid developer of the present invention may also contain a cationic polymerization inhibitor.

The cationic polymerization inhibitor can be exemplified by alkali metal compounds and/or alkaline-earth metal compounds and by amines.

The amines can be exemplified by alkanolamines, N,N-dimethylalkylamines, N,N-dimethylalkenylamines, and N,N-dimethylalkynylamines.

The amines can be specifically exemplified by triethanolamine, triisopropanolamine, tributanolamine, N-ethyldiethanolamine, propanolamine, n-butylamine, sec-butylamine, 2-aminoethanol, 2-methylaminoethanol, 3-methylamino-1-propanol, 3-methylamino-1,2-propanediol, 2-ethylaminoethanol, 4-ethylamino-1-butanol, 4-(n-butylamino)-1-butanol, 2-(t-butylamino)ethanol, N,N-dimethylundecanolamine, N,N-dimethyldodecanolamine, N,N-dimethyltridecanolamine, N,N-dimethyltetradecanolamine, N,N-dimethylpentadecanolamine, N,N-dimethylnonadecylamine, N,N-dimethylicosylamine, N,N-dimethyleicosylamine, N,N-dimethylheneicosylamine, N,N-dimethyldocosylamine, N,N-dimethyltricosylamine, N,N-dimethyltetracosylamine, N,N-dimethylpentacosylamine, N,N-dimethylpentanolamine, N,N-dimethylhexanolamine, N,N-dimethylheptanolamine, N,N-dimethyloctanolamine, N,N-dimethylnonanolamine, N,N-dimethyldecanolamine, N,N-dimethylnonylamine, N,N-dimethyldecylamine, N,N-dimethylundecylamine, N,N-dimethyldodecylamine, N,N-dimethyltridecylamine, N,N-dimethyltetradecylamine, N,N-dimethylpentadecylamine, N,N-dimethylhexadecylamine, N,N-dimethylheptadecylamine, and N,N-dimethyloctadecylamine. In addition to these, for example, a quaternary ammonium salt may also be used. The cationic polymerization inhibitor is particularly preferably a secondary amine.

The content of the cationic polymerization inhibitor is preferably 1 to 5,000 ppm on a mass basis in the ultraviolet-curable liquid developer.

<Radical Polymerization Inhibitor>

The ultraviolet-curable liquid developer of the present invention may also contain a radical polymerization inhibitor.

In the case of an ultraviolet-curable liquid developer that contains a vinyl ether compound, during storage the photoinitiator may undergo a trace decomposition and thereby convert into a radical compound and a polymerization caused by this radical compound may then be induced. A radical polymerization inhibitor is preferably added to prevent this.

Usable radical polymerization inhibitors can be exemplified by phenolic hydroxy group-containing compounds; quinones such as methoquinone (hydroquinone monomethyl ether), hydroquinone, and 4-methoxy-1-naphthol; hindered amine antioxidants; 1,1-diphenyl-2-picrylhydrazyl free radical; N-oxyl free radical compounds; nitrogen-containing heterocyclic mercapto compounds; thioether antioxidants; hindered phenol antioxidants; ascorbic acids; zinc sulfate; thiocyanates; thiourea derivatives; saccharides; phosphoric acid-type antioxidants; nitrites; sulfites; thiosulfates; hydroxylamine derivatives; aromatic amines; phenylenediamines; imines; sulfonamides; urea derivatives; oximes; polycondensates of dicyandiamide and polyalkylenepolyamine; sulfur-containing compounds such as phenothiazine; complexing agents based on tetraazaannulene (TAA); and hindered amines.

Phenolic hydroxy group-containing compounds, N-oxyl free radical compounds, 1,1-diphenyl-2-picrylhydrazyl free radical, phenothiazine, quinones, and hindered amines are preferred from the standpoint of preventing the ultraviolet-curable liquid developer from undergoing a viscosity increase due to polymerization of the vinyl ether compound. N-oxyl free radical compounds are more preferred.

The content of the radical polymerization inhibitor is preferably 1 to 5,000 ppm on a mass basis in the ultraviolet-curable liquid developer.

<Other Additives>

In addition to those described above, the ultraviolet-curable liquid developer of the present invention may as necessary contain various known additives to respond to the goals of improving the compatibility with recording media, improving the storage stability, improving the image storability, and improving other characteristics. For example, the following can be selected as appropriate and used: surfactant, lubricant, filler, antifoaming agent, ultraviolet absorber, antioxidant, anti-fading agent, fungicide, anticorrosion agent, and so forth.

The method of producing the ultraviolet-curable liquid developer in the present invention is not particularly limited and can be exemplified by known methods, for example, the coacervation method and the wet pulverization method.

An example of a general production method is a production method in which a colorant, a binder resin, other additives, and a dispersion medium are mixed; pulverization is carried out using, e.g., a bead mill, to obtain a dispersion of toner particles; and the obtained toner particle dispersion, a photoinitiator, cationically polymerizable liquid monomer, and so forth are mixed to obtain the ultraviolet-curable liquid developer.

The details of the coacervation method are described in, for example, Japanese Patent Application Laid-open No. 2003-241439, WO 2007/000974, and WO 2007/000975.

In the coacervation method, a pigment, resin, solvent that dissolves the resin, and solvent that does not dissolve the resin are mixed and the solvent that dissolves the resin is then removed from the mixture to cause the resin that had been dissolved to precipitate, thereby creating a dispersion of pigment-enclosing toner particles in the solvent that does not dissolve the resin.

The details of the wet pulverization method, on the other hand, are described in, for example, WO 2006/126566 and WO 2007/108485.

In the wet pulverization method, the pigment and binder resin are kneaded at or above the melting point of the binder resin; this is followed by a dry pulverization; and the obtained pulverized material is subjected to a wet pulverization in an electrically insulating medium, thereby creating a dispersion of toner particles in the electrically insulating medium.

Known methods such as these can be used in the present invention.

Viewed from the perspective of obtaining a high-definition image, the volume-average particle diameter of the toner particle is preferably at least 0.05 μm and not more than 5 μm and is more preferably at least 0.05 μm and not more than 1 μm.

The toner particle concentration in the ultraviolet-curable liquid developer in the present invention is not particularly limited, but is desirably made approximately at least 1 mass % and not more than 70 mass %, is preferably made approximately at least 1 mass % and not more than 50 mass %, and is even more preferably made approximately at least 2 mass % and not more than 40 mass %.

<Properties of the Ultraviolet-Curable Liquid Developer>

The ultraviolet-curable liquid developer of the present invention is preferably used having been prepared so as to have the same property values as common liquid developers.

Thus, viewed from the perspective of obtaining a suitable toner particle electrophoretic mobility, the viscosity of the ultraviolet-curable liquid developer at 25° C. for a toner particle concentration of 2 mass % is preferably at least 0.5 mPa·s and not more than 100 mPa·s. In addition, viewed from the perspective of not causing a drop in the potential of the electrostatic latent image, the volume resistivity of the ultraviolet-curable liquid developer is preferably at least $1\times10^{9}$ Ω·cm and not more than $1\times10^{15}$ Ω·cm and is more preferably at least $1\times10^{10}$ Ω·cm and not more than $1\times10^{13}$ Ω·cm.

The present invention makes possible the preparation of an ultraviolet-curable liquid developer that exhibits a high ultraviolet curability while also satisfying the property values indicated above.

[The Image-Forming Apparatus]

The ultraviolet-curable liquid developer of the present invention can be advantageously used in typical image-forming apparatuses that use an electrophotographic system.

<Light Source>

The image is fixed by curing the ultraviolet-curable liquid developer of the present invention through its exposure to ultraviolet radiation immediately after transfer to a recording medium.

The light source here for carrying out ultraviolet irradiation is suitably, for example, a mercury lamp, metal halide lamp, excimer laser, ultraviolet laser, cold cathode tube, hot cathode tube, black light, or light-emitting diode (LED). A strip-shaped metal halide lamp, cold cathode tube, hot cathode tube, mercury lamp, black light, or LED is preferred.

The ultraviolet dose is preferably from 0.1 to 1,000 $mJ/cm^2$.

The measurement methods used in the present invention are given in the following.

<Method of Measuring the Volume Resistivity>

With regard to the volume resistivity of the ultraviolet-curable liquid developer, the volume resistivity of the liquid developer is measured using an R8340A digital ultrahigh resistance/microcurrent meter (Advantest Corporation). The measurement is carried out by introducing 25 mL of the liquid developer into an SME-8330 liquid sample electrode (Hioki E.E. Corporation) and then applying 1,000 V direct current at a room temperature of 25° C.

<Compositional Analysis>

The following procedures are used for structural identification of the compounds.

The $^1$H-NMR and $^{13}$C-NMR spectra are measured using an ECA-400 (400 MHz) from JEOL Ltd.

The measurements are carried out at 25° C. in a deuterated solvent containing tetramethylsilane as the internal standard. The chemical shift values are given as the shift value (δ value) in ppm assigning 0 to the tetramethylsilane internal standard.

<Method for Measuring the Molar Average Number of Functional Groups and the Molar Average Molecular Weight>

The molar average number of functional groups in the present invention indicates, for a mixed system of compounds, the average number of functional groups per one molecule averaged over the number of moles, i.e., the number of molecules, of each component compound constituting the mixed system.

The molar average molecular weight, on the other hand, indicates the average molecular weight per one molecule averaged over the number of moles, i.e., the number of molecules, of each component compound constituting the mixed system.

Here, when one polymerizable functional group is present in one molecule of the cationically polymerizable liquid monomer, the number of polymerizable functional groups per one molecule is given by "1" (or monofunctional), while when n are present the number of polymerizable functional groups per one molecule is given by "n" (or n-functional).

In the case of a vinyl ether compound, when n vinyl ether structures (—CH═CH—O—C—) are present in one molecule of the vinyl ether compound, the number of polymerizable functional groups per one molecule is given by "n" (or n-functional).

The following method is used to determine the number of polymerizable functional groups per one molecule of vinyl ether compound in the ultraviolet-curable liquid developer and the molar average number of functional groups and to determine the molecular weight per one molecule of vinyl ether compound and the molar average molecular weight.

(1) The ultraviolet-curable liquid developer is subjected to centrifugal separation to sediment the toner particles and extract a supernatant.

(2) Through measurement of the supernatant by liquid chromatography and mass spectroscopy, the molecular weight and content of the contents are determined and fractionation into each molecular weight component is carried out.

(3) The chemical structure of each component is identified by measuring the $^1$H-NMR and $^{13}$C-NMR spectra of each fractionated component and the molecular weight, content, and number of polymerizable functional groups per one molecule are determined for the contained vinyl ether compound.

Here, while the chemical structure is identified by measurement of the $^1$H-NMR and $^{13}$C-NMR spectra, as necessary known analytical procedures such as infrared spectroscopy and gas chromatography may also be used in combination therewith.

(4) Using the equations given below, the molar average number of functional groups and the molar average molecular weight are determined from the molecular weight, content, and number of polymerizable functional groups per one molecule for each component that have been calculated in the preceding (2) and (3).

For example, taking the case of the use as the vinyl ether compound of a two-species mixture of a vinyl ether compound A and a vinyl ether compound B, and defining (Awt) as the mass parts of the vinyl ether compound A having a number of polymerizable functional groups (Af) and a molecular weight (Amw) per one molecule and (Bwt) as the mass parts of the vinyl ether compound B having a number of polymerizable functional groups (Bf) and a molecular weight (Bmw) per one molecule, then $$\text{molar average number of functional groups}=\{(Af\times Awt/Amw)+(Bf\times Bwt/Bmw)\}/\{(Awt/Amw)+(Bwt/Bmw)\}$$

$$\text{molar average molecular weight}=\{(Awt+Bwt)\}/\{(Awt/Amw)+(Bwt/Bmw)\}.$$

When the vinyl ether compound includes three or more species, the determination can be similarly carried out by extending these equations to a system of three or more components.

When the chemical structure determination in (3) above is problematic, the iodine value of the compound mixture can be determined and used as a substitute for the molar average number of functional groups. The molar average number of functional groups per 1 molecule can be calculated based on the iodine value and the results from (2) above, and the value of the A/B of the present invention can be calculated by calculating the molar average molecular weight from the results of (2).

The Wijs method and the Hanus method are widely known methods for measuring the iodine value, and the standard test methods given in, for example, the ASTM, DIN, and JIS standards can be used.

EXAMPLES

The present invention is more specifically described in the following using examples, but the present invention is not limited to or by these examples. Unless specifically indicated otherwise, the "parts" and "%" in the following description denote "mass parts" and "mass %", respectively.

Example 1

(Toner Particle Production)

25 parts of Nucrel N1525 (ethylene-methacrylic acid resin, Du Pont-Mitsui Polychemicals Co., Ltd.) and 75 parts of dodecyl vinyl ether (example compound B-3) were introduced into a separable flask and the temperature was raised over 1 hour to 130° C. on an oil bath while stirring at 200 rpm using a Three-One motor. After holding for 1 hour at 130° C., gradual cooling was carried out at a ramp down rate of 15° C. per 1 hour to produce a binder resin dispersion. The obtained binder resin dispersion was a white paste.

59.40 parts of this binder resin dispersion, Pigment Blue 15:3 (4.95 parts) as pigment, 0.20 parts of aluminum tristearate as a charge adjuvant, and 35.45 parts of dodecyl vinyl ether were filled into a planetary bead mill (Classic Line P-6, Fritsch) along with zirconia beads having a diameter of 0.5 mm, and pulverization was carried out at 200 rpm for 4 hours at room temperature to obtain a toner particle dispersion (solids fraction=20 mass %) that contained 80.00 parts of dodecyl vinyl ether.

The toner particles present in the obtained toner particle dispersion had a volume-average particle diameter of 0.85 μm (measured with a Nanotrac 150 from Nikkiso Co., Ltd., a particle size distribution analyzer based on dynamic light scattering (DLS)).

(Preparation of Liquid Developer)

An ultraviolet-curable liquid developer was obtained by mixing 10.00 parts of the aforementioned toner particle dispersion, 0.10 parts of hydrogenated lecithin (Lecinol S-10, Nikko Chemicals Co. Ltd.) as a charge control agent, 12.00 parts of cyclohexanedimethanol divinyl ether (example compound B-17) and 80.00 parts of trimethylolpropane trivinyl ether (example compound B-24) as cationically polymerizable liquid monomers, example compound A-26 (0.30 parts) as a photoinitiator, 0.50 parts of 2,4-diethylthioxanthone as a photopolymerization sensitizer, and 0.50 parts of 1,4-diethoxynaphthalene as a photopolymerization sensitizing aid. The obtained ultraviolet-curable liquid developer contained 8.00 parts of the dodecyl vinyl ether that was used in the production of the toner particle dispersion.

Examples 2 to 16 and Comparative Examples 1 to 9

Ultraviolet-curable liquid developers were obtained proceeding as in Example 1, but blending the cationically polymerizable liquid monomer, photoinitiator, photopolymerization sensitizer, and photopolymerization sensitizing aid as in Example 1 to give the compositions of Tables 1 and 2. 30.00 parts of the toner particle dispersion was used in Examples 12 and 13 and Comparative Examples 1 to 4.

In Tables 1 and 2, the cationically polymerizable liquid monomer 1 for Examples 1 to 4, Examples 6 to 10, Examples 12 to 16, and Comparative Examples 1 to 9 contains the dodecyl vinyl ether (example compound B-3) deriving from the toner particle dispersion, for Example 5 similarly contains cyclohexanedimethanol divinyl ether (example compound B-17), and for Example similarly contains 2-butyl-2-ethyl-1,3-propanediol divinyl ether (example compound B-27).

The polymerization initiators used in the comparative examples are as follows.

<Photoinitiator (D-1)>

CPI-110P (triarylsulfonium salt-type cationic photoinitiator, San-Apro Ltd.)

<Photoinitiator (D-2)>

WPI-113 (diphenyliodonium salt-type cationic photoinitiator, Wako Pure Chemical Industries, Ltd.)

(Evaluation Methods)

Evaluations were performed on the liquid developers of Examples 1 to 16 and Comparative Examples 1 to 9, and the results are given in Tables 1 and 2. The items evaluated and the evaluation results are as follows.

(Developing Performance: Evaluation of Image Density and Image Blurring)

An electrostatic pattern was formed at a surface charge of 500 V on electrostatic recording paper, and development was performed using the liquid developer at a process speed of 20 mm/sec using a roller developing device that used a metal roller. The gap between the roller and the electrostatic recording paper (the development gap) was set to 34 μm. The quality of the obtained image was visually inspected.

5: the obtained image had a high density and a high definition

4: a slight image density non-uniformity is present, or slight image blurring is seen 3: image density non-uniformity or image blurring is seen in spots, but a generally good development is recognized 2: severe image density non-uniformity and/or image blurring was produced and development was unsatisfactory 1: development could not be carried out (Evaluation of the Fixing Performance)

In a 25° C. room temperature and 50% humidity environment, the liquid developer was dripped onto a polyethylene terephthalate film and bar coating was carried out using a wire bar (No. 6) [supplier: Matsuo Sangyo Co., Ltd.] (a film with a thickness of 13.7 was formed).

A cured film was then formed: in Examples 1 to 13 and Comparative Examples 1 to 4 by exposure to light (irradiance=1000 mW/cm$^2$, exposure gap=15 mm) from an LED having an emission wavelength of 385 nm; in Examples 14 to 16 and Comparative Examples 5 to 9 by exposure to light from a high-pressure mercury lamp (lamp output=120 mW/cm$^2$) having an emission wavelength of 365 nm. The irradiated dose was measured at which surface tack (stickiness) was absent and complete curing had therefore occurred, and this was scored using the following criteria.

10: 100 mJ/cm$^2$

9: 150 mJ/cm$^2$

8: 200 mJ/cm$^2$

7: 300 mJ/cm$^2$

6: 400 mJ/cm$^2$

5: 800 mJ/cm$^2$

4: 1,000 mJ/cm$^2$

3: 1,500 mJ/cm$^2$

2: 2,000 mJ/cm$^2$

1: curing does not occur

The effects of the present invention with regard to the fixing performance were considered to be operative at a rank of 5 or greater.

TABLE 1

| | photoinitiator | | photo-polymerization sensitizer | photo-polymerization sensitizing aid | cationically polymerizable liquid monomer 1 | | cationically polymerizable liquid monomer 2 | | cationically polymerizable liquid monomer 3 | |
|---|---|---|---|---|---|---|---|---|---|---|
| | type | content (parts) | | | type | content (parts) | type | content (parts) | type | content (parts) |
| Example 1 | A-26 | 0.30 | YES | YES | B-3 | 8.00 | B-17 | 12.00 | B-24 | 80.00 |
| Example 2 | A-26 | 0.30 | YES | YES | B-3 | 8.00 | B-17 | 82.00 | B-28 | 10.00 |
| Example 3 | A-26 | 0.30 | YES | YES | B-3 | 8.00 | B-26 | 72.00 | B-24 | 20.00 |
| Example 4 | A-26 | 0.30 | YES | YES | B-3 | 8.00 | B-17 | 72.00 | B-26 | 20.00 |
| Example 5 | A-3 | 0.30 | YES | YES | B-17 | 20.00 | B-26 | 80.00 | none | |
| Example 6 | A-3 | 0.30 | YES | YES | B-3 | 8.00 | B-17 | 72.00 | B-26 | 20.00 |
| Example 7 | A-3 | 0.10 | YES | YES | B-3 | 8.00 | B-17 | 72.00 | B-26 | 20.00 |
| Example 8 | A-3 | 1.00 | YES | YES | B-3 | 8.00 | B-17 | 72.00 | B-26 | 20.00 |
| Example 9 | A-3 | 0.03 | YES | YES | B-3 | 8.00 | B-17 | 72.00 | B-26 | 20.00 |
| Example 10 | A-3 | 5.00 | YES | YES | B-3 | 8.00 | B-17 | 72.00 | B-26 | 20.00 |
| Example 11 | A-3 | 0.30 | YES | YES | B-27 | 100.00 | none | | none | |
| Example 12 | A-3 | 5.00 | YES | YES | B-3 | 24.00 | B-17 | 66.00 | B-24 | 10.00 |
| Example 13 | A-3 | 5.00 | YES | YES | B-3 | 24.00 | B-26 | 66.00 | B-24 | 10.00 |
| Comparative Example 1 | A-3 | 5.00 | YES | YES | B-3 | 24.00 | B-17 | 10.00 | B-26 | 66.00 |
| Comparative Example 2 | A-3 | 5.00 | YES | YES | B-3 | 24.00 | B-26 | 76.00 | none | |
| Comparative Example 3 | A-3 | 5.00 | YES | YES | B-3 | 40.00 | B-26 | 50.00 | B-24 | 10.00 |
| Comparative Example 4 | A-3 | 5.00 | YES | YES | B-3 | 100.00 | none | | none | |

| | volume resistivity (Ω · cm) | molar average number of functional groups (A) | molar average molecular weight (B) | evaluation | | |
|---|---|---|---|---|---|---|
| | | | | A/B × 1000 | fixing performance | developing performance |
| Example 1 | $2 \times 10^{10}$ | 2.71 | 210 | 12.9 | 10 | 5 |
| Example 2 | $2 \times 10^{10}$ | 2.09 | 201 | 10.4 | 10 | 5 |
| Example 3 | $4 \times 10^{10}$ | 2.12 | 212 | 10.0 | 10 | 5 |
| Example 4 | $4 \times 10^{10}$ | 1.92 | 200 | 9.6 | 10 | 5 |
| Example 5 | $4 \times 10^{10}$ | 2.00 | 209 | 9.6 | 9 | 5 |
| Example 6 | $4 \times 10^{10}$ | 1.92 | 200 | 9.6 | 9 | 5 |
| Example 7 | $6 \times 10^{10}$ | 1.92 | 200 | 9.6 | 8 | 5 |
| Example 8 | $1 \times 10^{10}$ | 1.92 | 200 | 9.6 | 8 | 4 |
| Example 9 | $8 \times 10^{10}$ | 1.92 | 200 | 9.6 | 7 | 5 |
| Example 10 | $3 \times 10^{9}$ | 1.92 | 200 | 9.6 | 8 | 3 |
| Example 11 | $4 \times 10^{10}$ | 2.00 | 212 | 9.4 | 6 | 5 |
| Example 12 | $4 \times 10^{9}$ | 1.87 | 201 | 9.3 | 6 | 3 |
| Example 13 | $3 \times 10^{9}$ | 1.86 | 212 | 8.8 | 6 | 3 |
| Comparative Example 1 | $3 \times 10^{9}$ | 1.76 | 210 | 8.4 | 4 | 3 |
| Comparative Example 2 | $4 \times 10^{9}$ | 1.76 | 212 | 8.3 | 4 | 3 |
| Comparative Example 3 | $3 \times 10^{9}$ | 1.70 | 212 | 8.0 | 3 | 3 |
| Comparative Example 4 | $4 \times 10^{9}$ | 1.00 | 212 | 4.7 | 2 | 3 |

TABLE 2

| | photoinitiator | | photo-polymerization sensitizer | photo-polymerization sensitizing aid | cationically polymerizable liquid monomer 1 | | cationically polymerizable liquid monomer 2 | | cationically polymerizable liquid monomer 3 | |
|---|---|---|---|---|---|---|---|---|---|---|
| | type | content (parts) | | | type | content (parts) | type | content (parts) | type | content (parts) |
| Example 14 | A-26 | 0.50 | YES | YES | B-3 | 8.00 | B-17 | 12.00 | B-24 | 80.00 |
| Example 15 | A-26 | 0.50 | YES | NO | B-3 | 8.00 | B-17 | 12.00 | B-24 | 80.00 |
| Example 16 | A-26 | 0.50 | NO | NO | B-3 | 8.00 | B-17 | 12.00 | B-24 | 80.00 |
| Comparative Example 5 | none | | NO | NO | B-3 | 8.00 | B-17 | 12.00 | B-24 | 80.00 |

TABLE 2-continued

| | | | | | | | | | | |
|---|---|---|---|---|---|---|---|---|---|---|
| Comparative Example 6 | D-1 | 1.00 | NO | NO | B-3 | 8.00 | B-17 | 12.00 | B-24 | 80.00 |
| Comparative Example 7 | D-1 | 5.00 | NO | NO | B-3 | 8.00 | B-17 | 12.00 | B-24 | 80.00 |
| Comparative Example 8 | D-2 | 1.00 | NO | NO | B-3 | 8.00 | B-17 | 12.00 | B-24 | 80.00 |
| Comparative Example 9 | D-2 | 5.00 | NO | NO | B-3 | 8.00 | B-17 | 12.00 | B-24 | 80.00 |

| | volume resistivity (Ω · cm) | molar average number of functional groups (A) | molar average molecular weight (B) | evaluation | | |
|---|---|---|---|---|---|---|
| | | | | A/B × 1000 | fixing performance | developing performance |
| Example 14 | $1 \times 10^{10}$ | 2.71 | 210 | 12.9 | 10 | 5 |
| Example 15 | $1 \times 10^{10}$ | 2.71 | 210 | 12.9 | 8 | 5 |
| Example 16 | $1 \times 10^{10}$ | 2.71 | 210 | 12.9 | 6 | 5 |
| Comparative Example 5 | $6 \times 10^{10}$ | 2.71 | 210 | 12.9 | 1 | 5 |
| Comparative Example 6 | $2 \times 10^{8}$ | 2.71 | 210 | 12.9 | 2 | 1 |
| Comparative Example 7 | $8 \times 10^{7}$ | 2.71 | 210 | 12.9 | 10 | 1 |
| Comparative Example 8 | $1 \times 10^{8}$ | 2.71 | 210 | 12.9 | 2 | 1 |
| Comparative Example 9 | $8 \times 10^{7}$ | 2.71 | 210 | 12.9 | 10 | 1 |

A satisfactory image density, little image blurring, and a satisfactory fixing performance were obtained when in Tables 1 and 2 both the fixing performance had a rank of 5 or greater and the developing performance had a rank of 3 or greater.

The results in Table 1 demonstrate that a satisfactory fixing performance is obtained in Examples 1 to 13—where the value of [A/B×1000] is at least 8.5—even at a curing energy of 400 mJ/cm$^2$, in contrast to the fact that a curing energy of at least 1000 mJ/cm$^2$ was required in Comparative Examples 1 to 4, which are prior art. The results in Table 1 also demonstrate that in Examples 1 to 10, where the value of [A/B×1000] is at least 9.5, a satisfactory fixing performance is obtained at a curing energy of 300 mJ/cm$^2$ or less.

The results in Table 2 demonstrate that a polymerization initiator that readily reduces the volume resistivity must be added in large amounts in order to obtain a satisfactory fixing performance and that the developing performance and fixing performance are then unable to co-exist.

In contrast to this, it is demonstrated that in Examples 14 to 16 of the present invention an excellent developing performance is exhibited while a good fixing performance is also obtained. Moreover, it is also shown that an excellent fixing performance is obtained, without impairing the development performance, by using a thioxanthone compound and a naphthalene compound as the photopolymerization sensitizer and the photopolymerization sensitizing aid.

The present invention can provide an ultraviolet-curable liquid developer that has a satisfactory fixing performance and that yields a high optical density while at the same time suppressing the appearance of image blurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107351, filed May 27, 2015, Japanese Patent Application No. 2016-043295, filed Mar. 7, 2016, which are hereby incorporated by reference herein in their entirety.

What is claimed is:

1. An ultraviolet-curable liquid developer comprising;

a toner particle containing a binder resin and a colorant;

a cationically polymerizable liquid monomer that does not dissolve the binder resin in the toner particle; and a photoinitiator, wherein the cationically polymerizable liquid monomer contains a vinyl ether compound satisfying A/B×1,000≥8.5 where A is the molar average number of functional groups for the vinyl ether compound and B is the molar average molecular weight of the vinyl ether compound, A and B satisfy the relationship A/B×1,000≥8.5; and the photoinitiator contains a compound represented by formula (1):

(1)

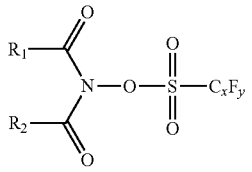

wherein $R_1$ and $R_2$ are bonded to each other to form a ring structure selected from the group consisting of a succinimide structure, a phthalimide structure, a norbornenedicarboximide structure, a naphthalenedicarboximide structure, a cyclohexanedicarboximide structure, and an epoxycyclohexenedicarboximide structure; x is an integer of 1 to 8; and y is an integer of 3 to 17.

2. The ultraviolet-curable liquid developer according to claim 1, wherein A/B×1,000≥9.5.

3. The ultraviolet-curable liquid developer according to claim 1, wherein the content of the compound represented by formula (1) is 0.05 to 1.00 mass part per 100 mass parts of the cationically polymerizable liquid monomer.

4. The ultraviolet-curable liquid developer according to claim 1, wherein the compound represented by formula (1) is a compound represented by formula (2):

(2)

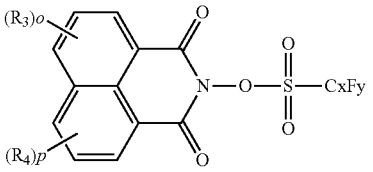

wherein x represents an integer of 1 to 8; y represents an integer of 3 to 17; $R_3$ and $R_4$ are independently selected from an alkyl group, alkyloxy group, alkylthio group, aryl group, aryloxy group, and arylthio group; o and p each independently represent an integer of 0 to 3 with the proviso that that when o is equal to or greater than 2, a plurality of $R_3$ may be bonded to each other to form a ring structure, and when p is equal to or greater than 2, a plurality of $R_4$ may be bonded to each other to form a ring structure; and an $R_3$ and $R_4$ may be bonded to each other to form a ring structure.

5. The ultraviolet-curable liquid developer according to claim 1, further comprising a photopolymerization sensitizer that contains a thioxanthone-type compound or an anthracene-type compound.

6. The ultraviolet-curable liquid developer according to claim 5, further comprising a photopolymerization sensitizing aid that contains a naphthalene-type compound.

* * * * *